United States Patent [19]

Gambetti

[11] Patent Number: 4,706,444

[45] Date of Patent: Nov. 17, 1987

[54] APPARATUS FOR WRAPPING CONTINUOUSLY MOVING ARTICLES WITH HEAT-SHRINKABLE MATERIAL

[75] Inventor: Mario Gambetti, Crevalcore, Italy

[73] Assignee: Baumer di Mario Gambetti, Castelfranco Emilia, Italy

[21] Appl. No.: 914,635

[22] Filed: Oct. 2, 1986

[30] Foreign Application Priority Data

Nov. 11, 1985 [IT] Italy ..... 3598 A/85

[51] Int. Cl.[4] ..... B65B 11/08

[52] U.S. Cl. ..... 53/557; 53/389; 53/228

[58] Field of Search ..... 53/210, 228, 230, 231, 53/232, 389, 557

[56] References Cited

U.S. PATENT DOCUMENTS

| | | | |
|---|---|---|---|
| Re. 27,977 | 4/1974 | Monaghan | 53/210 X |
| 2,424,406 | 7/1947 | Marshall | 53/449 |
| 2,918,772 | 12/1959 | Bell | 53/228 |
| 3,271,257 | 3/1975 | Schmermund | 424/3 |
| 3,660,961 | 5/1972 | Ganz | 53/210 X |
| 3,791,100 | 2/1974 | Monaghan | 53/210 X |
| 3,869,844 | 3/1975 | Edouard | 53/442 |
| 3,927,507 | 12/1975 | Reid | 53/553 |
| 4,574,565 | 3/1986 | Gambetti | 53/228 X |

FOREIGN PATENT DOCUMENTS

| | | | |
|---|---|---|---|
| 2555425 | 6/1976 | Fed. Rep. of Germany | 53/228 |
| 958377 | 5/1964 | United Kingdom . | |
| 1037261 | 7/1966 | United Kingdom . | |
| 1355466 | 6/1974 | United Kingdom . | |
| 1382842 | 2/1975 | United Kingdom . | |
| 1589778 | 5/1981 | United Kingdom . | |
| 2160843 | 1/1986 | United Kingdom . | |

*Primary Examiner*—John Sipos

*Attorney, Agent, or Firm*—Karl F. Ross; Herbert Dubno

[57] ABSTRACT

An improved machine for wrapping continuously moving articles with heat-shrinkable material comprising a series of at least three horizontally aligned coplanar longitudinally spaced conveyors provided with a monodirectional continuous movement and with the adjacent sections of the two conveyors furthest downstream wound on at least a corresponding pair of return rollers supported by a support carriage which may be moved in an alternate manner parallel to the conveyor direction, means for supplying sheets of wrapping material and a pair of winding bar means caused by conveyor means to move continuously around the article being supplied on the intermediate conveyor such that during each rotation, while one of the bars takes a sheet of wrapping material and brings it across the path of a following continuously moving article so as to wind this material about three faces of this article, the other bar winds the material about the fourth face of the preceding article and, by means of the two adjacent conveyors furthest downstream, superimposes the final flap on the flap which has already been folded over the lower face of the said preceding article.

5 Claims, 7 Drawing Figures

APPARATUS FOR WRAPPING CONTINUOUSLY MOVING ARTICLES WITH HEAT-SHRINKABLE MATERIAL

FIELD OF THE INVENTION

The invention relates to an apparatus for wrapping continuously moving articles with a web of heat-shrinkable material.

BACKGROUND OF THE INVENTION

The technique currently used to wrap monobloc articles of a predominantly prismatic shape with heat-shrinkable material, or more frequently to wrap groups of individual articles formed, for example, by containers of products, in particular, food products and the like, and having this monolithic prismatic shape, hereafter called articles for simplicity, involves the use of discontinuously or continuously operating automatic machines constructed to wind the heat-shrinkable material about the individual articles to be wrapped in a number of ways.

Using this wrapping technique it is conventional to wrap the article to be wrapped with the heat-shrinkable strip material in the direction of its movement such that this material projects from two opposite faces of the article and then to pass this assembly through a tunnel furnace to cause the material to adhere by heat shrinkage to the wrapped faces and to the two opposite faces of the article by folding the corresponding material over these latter faces.

Some of these known machines for wrapping such individual articles caused to advance intermittently or continuously in a continuous sequence and uniformly spaced from one another use two strips of the heat-shrinkable material which, at a sealing station, are brought rhythmically upwards and downwards between two successive articles where they are transversely joined by soldering and then cut so as progressively to determine the closure or sealing of the wrapping or winding of a previous article and the joining of the same strips for winding of the following article. The articles wrapped in this way are then passed through a tunnel furnace to cause the material to adhere to the wrapped faces by heat shrinkage and to the opposite two faces of the article by folding of the corresponding material over these latter two faces (see for example, the U.S. Pat. Nos. 3,869,844 and 3,927,507).

Other known machines designed to wrap such articles caused to advance continuously with a uniform spacing make use of a single strip of the heat-shrinkable material.

One of these known machines supplies the strip parallel to the direction of movement of the articles which are uniformly spaced in a longitudinal direction. The strip or web is folded progressively as it advances into a tubular shape with its respective longitudinal edges superimposed about the articles being supplied and these superimposed edges are joined by heat sealing. The articles wrapped or enclosed in the tube are then caused to pass, continuing their continuous movement, firstly through an initial station or initial tunnel furnace for initial heat shrinkage of the material about the articles and then, on discharge from this initial station, through a second station designed to cut the tube between two successive articles so as to provide projecting material about the whole of the front and rear faces of two successive articles. The articles are then passed and finally through a third station or a second tunnel furnace to complete the adhesion by heat shrinkage of the material to the wrapped faces and the front and rear faces of the article by folding the corresponding material over these latter two faces (see British Patent Specification No. 1 382 842).

In another of these known machines using a single strip or web to wrap articles supplied continuously with a uniform spacing the strip is supplied downwardly so as to extend it over the articles and projects from two opposite lateral faces, and to bring it, unwinding it downwardly from a corresponding spool, into a folded loop shape between successive articles and to push it in the direction of supply of the articles below the preceding article where the loop section is cut providing two ends or flaps of wrapping material, i.e. a rear flap for the preceding article and a front flap for the immediately following article.

During the continuous movement of the articles, the flaps for each article are superimposed on one another on the lower face or base of the article and the articles wrapped in this way are, during their continuous movement, then brought successively inside a tunnel furnace so as to cause the wrapping material to adhere by heat shrinkage, as is conventional, to the wrapped faces and to the two opposite faces of the article by folding of the corresponding material over these latter two faces (see British Patent Specification No. 1 355 571).

The prior art relating to packaging also discloses the method of bringing sheets or sections of wrapping material cut progressively from a strip wound on a supply spool across the path of the continuously moving articles to be wrapped so as to fold them into the shape of a horizontal U over the front face and the parallel upper and lower faces adjacent thereto of the articles with the end portions of the prongs of the U extending beyond the rear face and then to fold these end portions over the rear face and to join or seal them in a partially superimposed manner. The means provided to embody this packaging method are normally formed by at least two pairs of opposite closed circuit belt means designed to grip the longitudinal edges of these sheets in order to bring them across the path of movement of the articles to be wrapped (see British Pat. No. 1 037 261 and U.S. Pat. No. 2,424,406). To such closed circuit means disposed at the longitudinal edges and designed to entrain them by suction (see British Pat. No. 958 377 and U.S. Pat. No. 3,871,257).

Machines which use this latter method of folding the wrapping material into a U shape with the folding and final joining of the edges of the sheets by sealing at the rear faces of the articles to be wrapped require complicated devices both for the final folding operation and for the sealing operation, as a result of which, in the case of machines for wrapping articles with heat-shrinkable material which are already provided with a tunnel furnace to cause the heat-shrinkable, and therefore heat-sealable, material to adhere to the articles by heat-shrinkage, it is preferred, although not always possible, to use the method described above which involves initial folding of the heat-shrinkable material about the front, upper and rear faces of the article in the shape of an upturned U and then folding and partial superimposition of the end portions of this upturned U on the lower face of the article.

Attempts to eliminate these complicated folding and sealing devices for portions of flaps on the rear face of the products using the heat source of the tunnel furnace to join and seal the superimposed portions of the flaps of the U of wrapping material on the lower face of the articles at the same time as the operation in this furnace to cause the heat-shrinkable wrapping material to adhere to the product by heat shrinkage so as to provide greater flexibility, i.e. a higher production speed per unit of time, and a more economic cost for these machines for wrapping with heat-shrinkable material, have not in practice enabled the achievement of these objectives as a result of the complexity of the apparatus used for folding and superimposition of the end portions of the material in the shape of an upturned U on the lower faces of these articles (see, for example, the above-mentioned British Patent Specification No. 1 355 571).

Applicants has also used this method in U.S. Pat. No. 4,574,565 proposing and subsequently which discloses a machine for wrapping articles supplied with a uniform spacing by means of a continuously moving conveyor with sheets cut progressively from a strip of heat-shrinkable material projecting from two lateral faces of these articles and brought in succession by suction take-up means along their respective longitudinal edges across the path of movement between individual successive articles so as to be folded over the front, upper and lower faces of a corresponding article in the shape of an upturned U extending beyond the rear face so as to be folded over this rear face and superimposed on the end portion folded over the lower face, this conveyor being formed by two adjacent conveyor belt sections and the said take-up means supported at the zone between the two adjacent belt sections and in which the adjacent zones of the two belts are wound on at least a corresponding pair of return rollers supported by a carriage which may be moved in an alternating manner parallel to the conveyor direction and the take-up means being movable in a vertical alternating manner parallel to the movement of the carriage.

OBJECT OF THE INVENTION

The object of the present invention is to provide an improved apparatus of this latter type with improved means for the supply across the path of the articles to be wrapped of the sheets cut progressively from a strip of heat-shrinkable wrapping material and to improve the efficiency of the two adjacent conveyor belt sections.

SUMMARY OF THE INVENTION

In substance, these different means for the supply of sheets of wrapping material comprise at least a pair of wrapping bars brought horizontally with a continuous movement along a path surrounding the continuously moving article to be wrapped such that, while one of the bars wraps the wrapping material about a subsequent article in the shape of a horizontally upturned U over the front face and the upper and lower faces of this subsequent article, the other bar folds the end portion of the wrapping material about the rear face of the preceding article while the final end of this end portion is folded over the lower face above the initial portion by the two improved adjacent conveyor belt sections.

U.S. Pat. No. 3,791,100 discloses a machine for wrapping discontinuously supplied articles with heat-shrinkable material using a conveyor system which is coordinated with the movement of at least one wrapping bar for the subsequent positioning of an end of a section of wrapping material on an end of a conveyor actuated intermittently by the conveyor system. An article to be wrapped is disposed above the positioned end of the wrapping material and then brought forward until it rests completely on the conveyor after which the conveyor is stopped. While the article is on the stationary conveyor, the wrapping bar is moved along a path surrounding the conveyor and brings the opposite end of the wrapping material about the article, positioning it such that when the article moves above a further conveyor of the system, the latter folds the end positioned under the article, and the flap is then sealed and the wrapping material subjected to heat-shrinkage to form an adhesive sleeve-like casing or wrapping. This U.S. patent also discloses means for controlling the supply of the wrapping material from a continuous spool mounted below the conveyor system and disposed within the path of movement of the winding bar, designed to separate the section of desired length of the material and to maintain the front end of the separated material in position on the end of the discontinuous conveyor until the article is disposed thereon.

A machine of this type more particularly comprises a wrapping conveyor having an input end, an output end and an upper surface between these two ends to support and convey successive articles to be wrapped, means for receiving articles adjacent to the output end of the wrapping conveyor but spaced therefrom, an endless conveyor supporting at least one wrapping bar along a path which surrounds the wrapping conveyor so as to wrap the material about an article on the wrapping conveyor, means for supplying the wrapping material designed to supply a first section of wrapping material to the wrapping conveyor and to dispose the front end thereof above the upper surface of this wrapping conveyor adjacent to its input end, these supply means for the wrapping material including means for keeping this first section of material suspended across the path of the winding bar, and means including this winding bar designed to grip the suspended section and bring it forward to the input end of the wrapping conveyor, means for supplying articles designed to supply at least a first article to be wrapped at the input end of the wrapping conveyor and at the front end of the wrapping material, first sensor means actuated when the first article is positioned on the conveyor in a predetermined position, with at least part of this article disposed on the front end of the wrapping material, and designed to stop the wrapping conveyor, means operative when the conveyor is stationary designed to initiate the movement of the endless conveyor means and the wrapping bar along the said path so as to convey the rear end of this first section of material upwardly, above the first article, and downwardly, opposite thereto, adjacent to the output end of the wrapping conveyor, while the front end of the wrapping material is held below this article, these supply means for the wrapping material being synchronized with the wrapping bar to provide a second section of the wrapping material and to bring the front end thereof to the input end of the conveyor while the wrapping bar is conveying the rear end of the first section upwardly, above, and downwardly, opposite to this first article, and means which may be actuated when the wrapping material has been conveyed in this way around the first article to move this article onto the means for receiving articles to cause the rear end of this wrapping material to be superimposed on the front end thereof, below the article.

With a machine constructed in this way, the article to be wrapped is stopped at the time of wrapping with the wrapping material by means of the wrapping bar which is also stopped during the stages of forward movement of the article before and after the wrapping stages as a result of which a machine of this type is universally defined as a machine with a low production speed per unit of time.

With the improved machine of the present invention, substantially as described above, it has been possible significantly to increase the production speed per unit of time as a result in particular of the superimposition of stages for the wrapping of the continuously moving article and, more precisely, the fact that while one of the bars winds the wrapping material about three faces of a subsequent article, the other bar wraps the fourth face of the preceding article and, as a result of the continuous movement of the article, the automatic superimposition of the final flap on the flap already folded over the lower face by means of the improvement of the underlying conveyors. Consequently the improved machine of the invention comprises a series of at least three horizontally aligned coplanar longitudinally spaced conveyors provided with a monodirectional continuous movement and with the adjacent sections of the two conveyors furthest downstream wound on at least a corresponding pair of return rollers supported by a support carriage which may be moved in an alternate manner parallel to the conveyor direction, means for supplying sheets or sections of heat-shrinkable wrapping material in a spaced sequence and winding bar means caused by conveyor means to move continuously around the article being supplied on the intermediate conveyor. According to the invention at least one pair of bar means are provided in a spaced sequence along the continuously moving conveyor means such that during each rotation, while one of the bars takes a sheet of wrapping material in a suspended manner and brings it across the path of a following continuously moving article so as to wind this material about three, i.e. the front, upper and lower, faces of this article, the other bar winds the material about the fourth face of the preceding article and by means of the two adjacent conveyors furthest downstream superimposes the final flap on the flap already folded over the lower face of this preceding article.

BRIEF DESCRIPTION OF THE DRAWING

Further features and advantages of the improved machine of this invention will be described in detail in the following description with reference to the attached drawing, in which.

SPECIFIC DESCRIPTION

Figure 1:
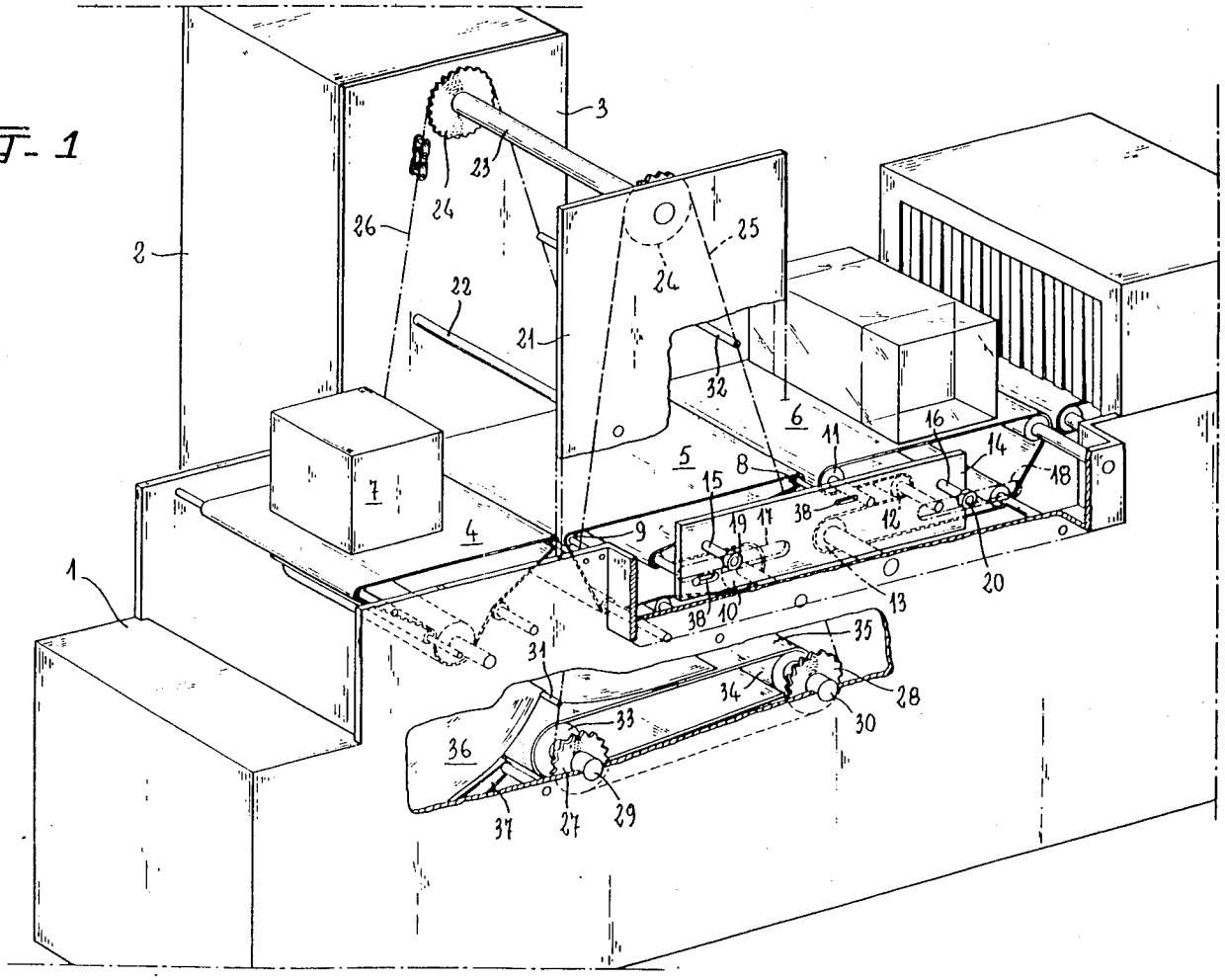
FIG. 1 is a front-longitudinal perspective diagrammatic view of this improved machine.

The machine shown in diagrammatic form in FIG. 1 for wrapping of a sequence of continuously moving articles with sheets or sections progressively cut from a strip of heat-shrinkable material essentially comprises a bench base 1 and a vertical shoulder box 2 with a front support wall 3. Three horizontal coplanar conveyors are supported on the base 1 as shown in FIG. 1, each of these conveyors being formed in a known manner by a corresponding conveyor belt wound in closed circuit form about respective return rollers as shown in the Figures.

These conveyor belts are numbered 4, 5 and 6 starting with the upstream belt, i.e. from left to right in the Figure, and have an identical speed which is greater than the speed of an upstream conveyor belt, not shown, but which is disclosed in my U.S. Pat. No. 4,574,565, for the uniform spacing of the articles 7 to be wrapped in the manner shown in FIGS. 2 to 7. As set out in U.S. Pat. No. 4,574,565, the belts of the adjacent ends of the conveyor belts 5 and 6 are returned in an opposing zig-zag form by three rollers, respectively 8, 9 and 10 and 11, 12 and 13. The rollers 10 and 13 are supported on the base 1 of the machine, while the rollers 8, 9 and 11, 12 are supported by a carriage 14 supported slideably on the base 1 by means of projections 15 and 16 rigid therewith and engaging in a slideable manner with respective slots 17 and 18 in the base 1 by corresponding idler wheels 19 and 20.

In the position facing the vertical shoulder box 2, the base 1 of the machine supports a vertical shoulder 21 connected to the vertical shoulder box 2 by stiffening rods 22. This vertical shoulder box 2 and the vertical shoulder 21 support in a rotary manner at the top a shaft 23 at whose opposite ends there is supported a corresponding wheel 24 which drives (see FIGS. 2–7) corresponding conveyor elements 25 and 26 in a clockwise direction in a closed circuit around corresponding drive wheels 29 and 30 supported by the base 1 below the conveyor belt 5 and the carriage 14. One of these shafts 23, 29 and 30 is motor-driven by the kinematic mechanism of the machine designed to provide the said conveyor elements 25 and 26 with this clockwise movement. The conveyor elements 25 and 26 support a pair of horizontal wrapping bars 31 and 32 spaced uniformly along the closed path of the conveyor elements 25 and 26, as shown in FIGS. 2 to 7. On the inside with respect to the pairs of wheels 27 and 28, on the shafts 29 and 30 there are mounted corresponding rollers 33 and 34 around which there is wound a conveyor belt 35 designed in a known manner to grip a sheet or section of wrapping material being supplied in the manner to be described below.

The machine described above operates as follows:

When the machine is in operation, the conveyor belts 4, 5 and 6 convey, via the kinematic mechanisms of the machine itself, the uniformly spaced articles 7 shown in FIGS. 2 to 7 with a continuous movement to the right.

Figure 2:
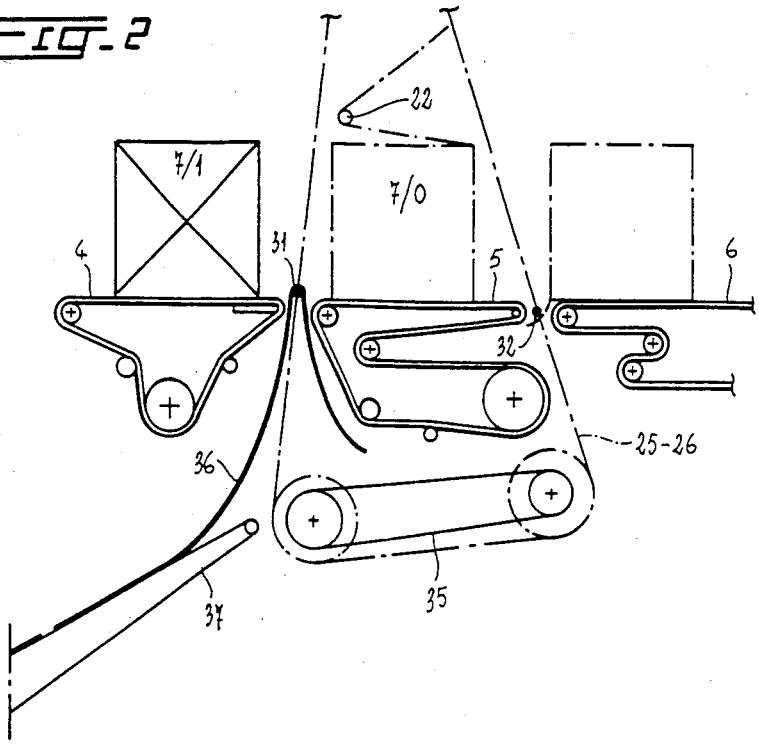
FIGS. 2 to 7 show some operational stages of the machine in diagrammatic form.
Figure 3:
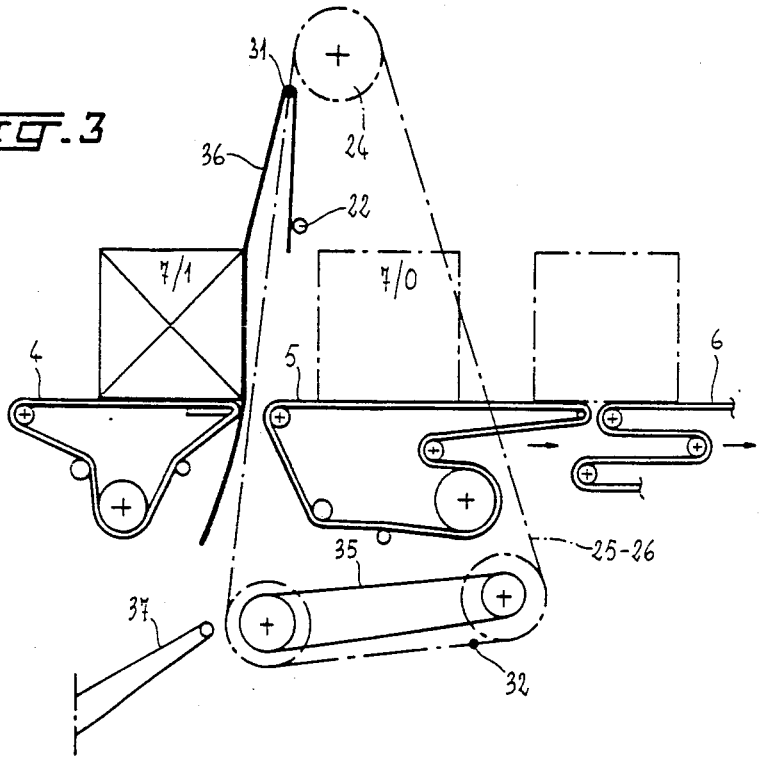
Figure 4:
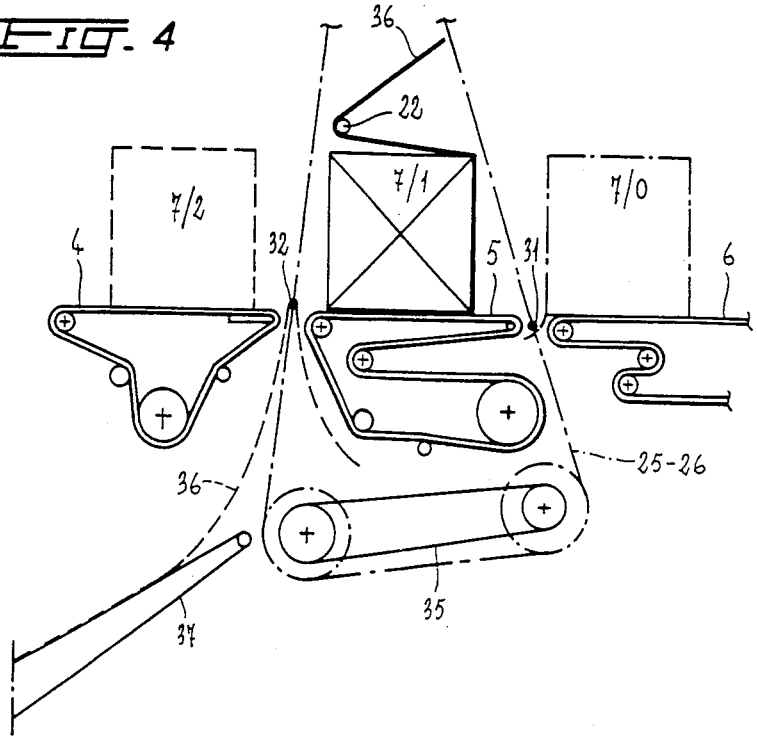
Figure 5:
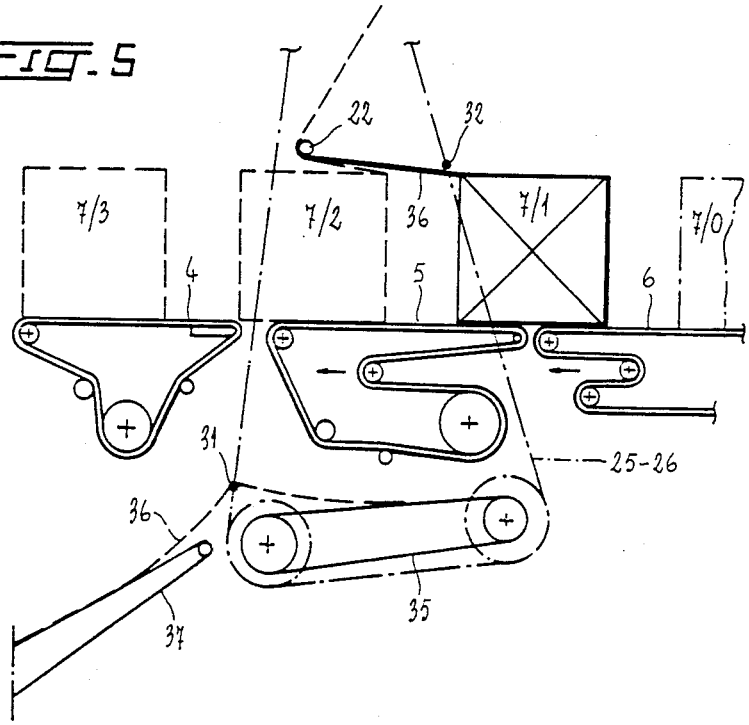
Figure 6:
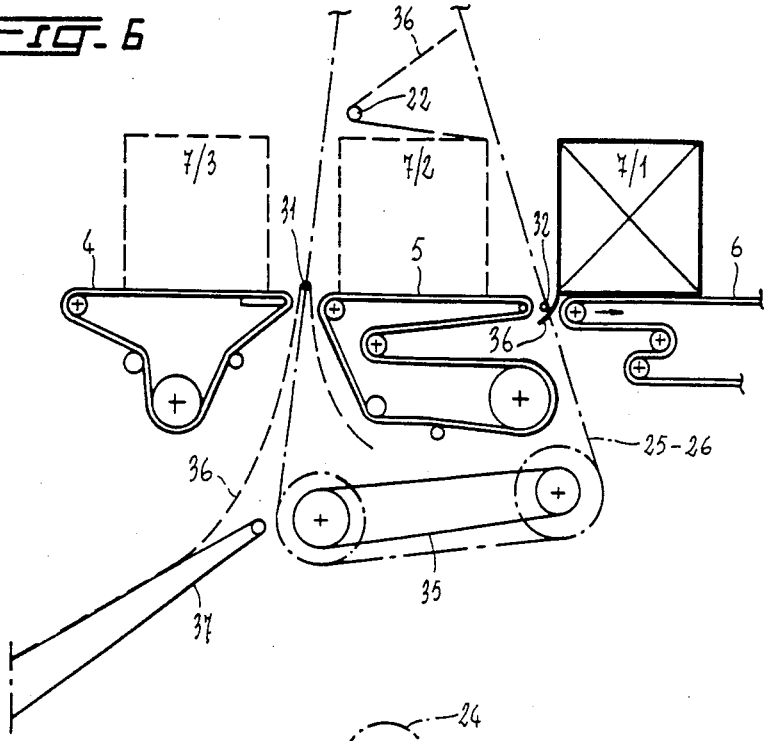
Figure 7:
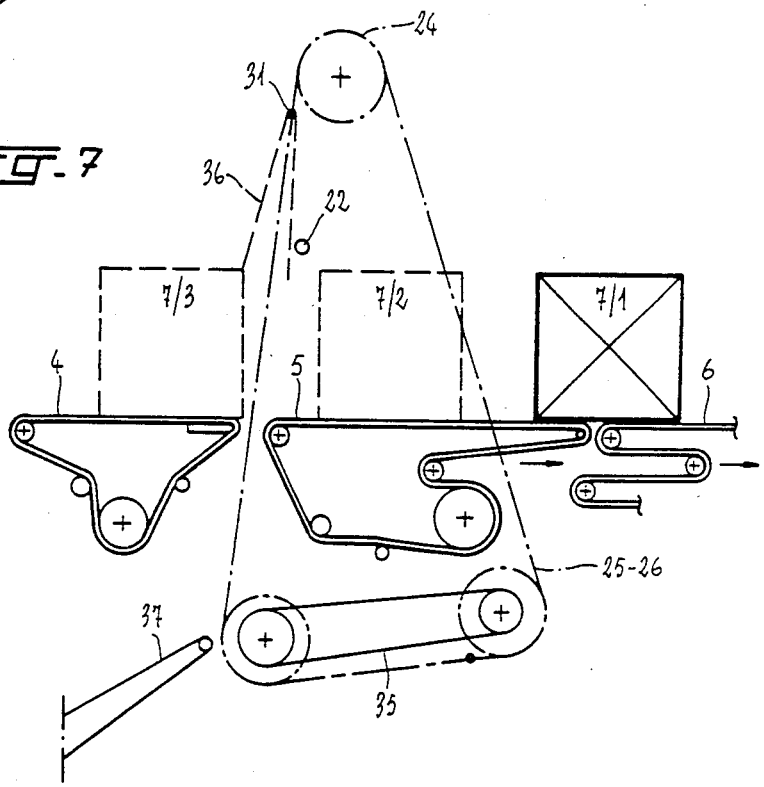

At the same time, a sheet of wrapping material, designated by 36, is supplied by the convyor belt 37 to the conveyor belt 35, as shown broken lines in FIG. 5, and intercepted by the wrapping bar 31 which entrains it upwardly as shown in FIG. 2. Following the continuous rotation of the conveyor elements 25 and 26 and therefore of the horizontal wrapping bars 31 and 32, the wrapping bar 31, in its upward movement, entrains the sheet of wrapping material 36 across the path of forward movement of the articles 7, in this case specifically the article 7/1, as shown in FIG. 3, so as to wrap this article 7/1 progressively with the sheet of wrapping material 36, as shown in FIG. 4, about its front, upper and lower faces and then, as shown in FIG. 4, to fold the flap remaining from a similar operation carried out on a preceding article 7/0 over the fourth face of this preceding article 7/0. At this point, using means which are not shown, the rollers 8 and 9 of the conveyor 5, whose respective shaft is engaged in respective slots 38 in the carriage 14, are forwardly accelerated on the carriage 14 towards the conveyor belt 6 so as to fold the end portion of this flap over the initial portion of the flap folded over the lower face below the preceding article 7/0 as shown in FIGS. 6 and 7 in respect of the wrapping bar 32 for the subsequent article 7/1.

A machine cycle of this type designed for the complete wrapping of an article substantially consists in that while one of the bars, 31, 32, takes a sheet of wrapping material being supplied in order to bring it across the path of a subsequent continuously moving article so as to wrap it about three faces, i.e. the front, upper and lower faces, the other bar wraps the fourth face of the preceding article such that by means of the acceleration of the rollers 8 and 9 with respect to the movement of the carriage 14, the wrapping of the article may be completed in the manner described above by the superimposition of the final flap on the flap already folded over the lower face of the preceding article.

The description of the improved machine in question given with reference to the attached drawings is obviously given solely by way of example and it is therefore evident that any modifications or variants suggested by practice and its embodiment and use may be made thereto provided that they do not depart from the scope of the attached claims.

I claim:

1. An apparatus for continuously wrapping a succession of articles comprising:

conveyor means defining a continuously moving transport path for said articles, said conveyor means including:

a first conveyor for delivering oncoming articles along a substantially horizontal surface thereof, a second conveyor having a substantially horizontal surface coplanar with said horizontal surface of said first conveyor and spaced therefrom downstream along said path for receiving said articles from said first conveyor, a third conveyor having a substantially horizontal surface coplanar with said horizontal surface of said second conveyor and downstream thereof along said path, all of said horizontal surfaces of said conveyors being driven in a common direction of advance of said articles along said path, and means for reciprocating a leading edge of said horizontal surface of said second conveyor and a trailing edge of said horizontal surface of said third conveyor relative to an article on said third conveyor;

means for supplying sheets of a heat-shrinkable material to a location below said horizontal surfaces of said first and second conveyors; and transport means for displacing at least one pair of bars spaced apart along said transport means in a closed path passing between said first and second conveyors and between said edges of said second and third conveyors in which one of said bars lifts one of said sheets between said horizontal surfaces of said first and second conveyors and applies the lifted sheet to a leading face of an article as it passes from said first conveyor onto said second conveyor and carries said lifted sheet over the top of the article as it moves along said second conveyor, while the other of said bars applies a previously lifted sheet to a rear face of an article previously transferred to said third conveyor from said second conveyor, said transport means being synchronized with said means for reciprocating said edges so that a leading portion of each sheet between said edges is advanced under each article on said third conveyor after said other bar has applied said sheet to the respective rear face, thereby causing said leading portion to meet a trailing portion of the same sheet brought to underlie the respective article by movement of the respective article onto the second conveyor.

2. The apparatus defined in claim 1, further comprising a bar disposed above said second conveyor along said path for guiding said lifted sheet over the top of the article as it moves along said second conveyor.

3. The apparatus defined in claim 1, wherein each of said conveyors has an endless belt and said edges of said second and third conveyors are defined by pairs of rollers deflecting the respective belts in a zigzag pattern, said pairs of rollers being coupled for joint displacement to reciprocate said edges.

4. The apparatus defined in claim 1, wherein said transport means includes pairs of chains flanking said path and engaging said barts at opposite ends thereof.

5. The apparatus defined in claim 1, further comprising a tunnel furnace for heat-shrinking said material on said articles downstream of said third conveyor.

* * * * *